United States Patent [19]

Grossniklaus

[11] 4,185,567

[45] Jan. 29, 1980

[54] WOOD-FIRED FURNACE ASSEMBLY WITH AUTOMATIC FIRE CHAMBER CHARGER

[76] Inventor: Hans Grossniklaus, Garage, 3855 Brienz, Switzerland

[21] Appl. No.: 893,256

[22] Filed: Apr. 5, 1978

[30] Foreign Application Priority Data

Apr. 6, 1977 [CH] Switzerland ..... 4347/77

[51] Int. Cl.[2] ..... F23M 1/06; F23K 5/00

[52] U.S. Cl. ..... 110/101 R; 110/109; 110/293

[58] Field of Search ..... 122/30; 110/293, 294, 110/101 R, 109

[56] References Cited

U.S. PATENT DOCUMENTS

| | | | |
|---|---|---|---|
| 2,056,538 | 10/1936 | Schickler | 110/109 |
| 2,454,400 | 11/1948 | Norman | 122/30 |
| 3,303,946 | 2/1967 | Wilkins | 110/109 |
| 4,036,124 | 7/1977 | Seiler et al. | 110/109 |

*Primary Examiner*—Kenneth W. Sprague
*Attorney, Agent, or Firm*—Brady, O'Boyle & Gates

[57] ABSTRACT

A ram is connected to reciprocate its free end up to or into a reinforced aperture in the bottom of one side wall of a wood receiving container to break wood positioned therebetween and push it through the aperture into a feed duct that is connected at its opposite end to the fire chamber of a furnace. The bottom of the container has a higher region and a lower region that is positioned adjacent the aperture and transverse of the ram and which extends either approximately horizontal or inclined downwardly away from both sides of the ram. Pusher flaps with actuating devices are pivotally connected to push material across the regions of the bottom toward the path of the ram and a member pivoted on the side-wall above the aperture is actuated to press material downwardly into the ram path in front of the aperture.

17 Claims, 6 Drawing Figures

WOOD-FIRED FURNACE ASSEMBLY WITH AUTOMATIC FIRE CHAMBER CHARGER

BACKGROUND OF THE INVENTION

The invention relates to a wood-fired furnace assembly having an automatic charging device for the fire chamber.

In the case of known wood-fired furnace assemblies of this kind, wood is processed by means of a comminuting installation into small-sized material for conveyance of a specific particle size, and is fed by means, such as pneumatic conveying assembly or a worm conveyor, or the like, to the fire chamber.

The invention starts from the fact that firewood occurs in different shapes, for example, as branches, portions of treetrunks, pieces of furniture, crates, sawdust, etc., and in different natures, such as dry or damp wood of different kinds. What is disadvantageous in the case of the known assemblies or apparatus is the fact that only adequately comminuted wood can be used.

The problem underlying the object of the invention is to provide an assembly or apparatus of this kind for which wood of any desired size, shape and nature can be used.

SUMMARY OF THE INVENTION

In accordance with the invention, this problem is solved by an assembly wherein a container for the reception of wood has at the bottom, in a side-wall, an aperture which is reinforced at its edge and which opens into a feed duct leading to a fire chamber, and into which or up to which a ram extends intermittantly. The ram is reciprocated in the container by means of a drive device, and the cross-section of the ram at the end facing the aperture is the same as or smaller than the aperture, and extends at the end of the working stroke into or up to the aperture. The region of the container bottom which adjoins the side-wall having the aperture therein extends at least approximately horizontally or is inclined on both sides of the path of the reciprocating ram downwardly away from the ram, and the dimension of this region transversely to the ram amounts to a multiple of the diameter of the end of the ram.

The size and shape of the wood which can be used in the apparatus is limited only by the size of the container and the working stroke of the ram.

The mode of operation of the apparatus in accordance with the invention is as follows: Upon occurance of the working stroke of the ram, the ram shifts pieces of wood present at the bottom of the container against the aperture and breaks these up at the aperture under pressure from the ram insofar as their dimensions transversely to the aperture are greater than the width of the aperture, in which respect these pieces of wood splinter and disintegrate.

Pieces of wood which lie in front of the aperture and which are smaller relative to the width thereof, and the fractured pieces of wood, are pushed through the aperture into the feed duct and, after running through the duct, pass into the fire chamber of the furnace.

The wood splintered and disintegrated by the ram is particularly well suited for combustion, obviously on account of air gaps which have arisen, and both large pieces of wood, such as pieces of furniture, crates, portions of tree-trunks, etc., and wood chips, sawdust, cardboard, paper waste and so forth can be used together in the assembly.

The drive device for the ram may be a hydraulic cylinder. The container is preferably approximately parallelepipedal, in which the aperture is disposed at the bottom in one of the four side walls and the ram and the feed duct extend horizontally in alignment with the aperture. Mounted in each of the remaining side-walls is a respective pusher flap which can be swung into the container and back agains substantially in alignment with the side-wall, by means of a respective hydraulic cylinder and which transports or pushes wood, lying against the wall, toward a position in front of the aperture.

BRIEF DESCRIPTION OF THE DRAWINGS

Two exemplified embodiments of the wood-fired furnace installation which can be used, for example, in a central heating installation for heating a building will be described in more detail hereinunder with reference to the accompanying drawings, in which.

DESCRIPTION OF THE PREFERRED EMBODIMENTS

Figure 1:
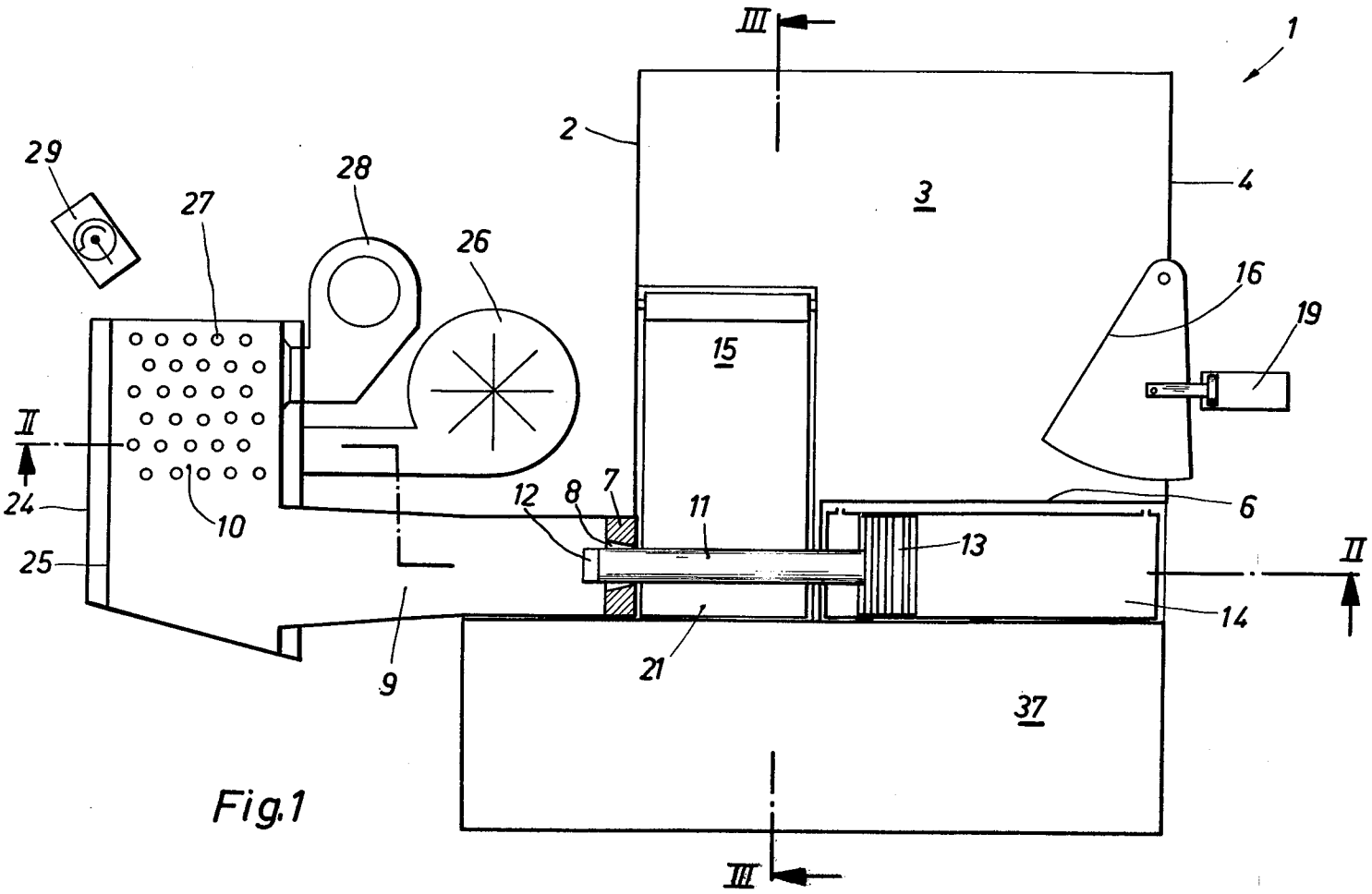
FIG. 1 is a schematic vertical longitudinal section view through a furnace assembly according to the invention.

The wood-fired furnace assembly shown in FIGS. 1 to 4 has a container 1 which is open at the top for the charging of the wood (not shown) of any desired shape, size and nature and which has four vertical side-walls 2,3,4 and 5 standing at right angles to one another, and a bottom wall 6. Disposed at the lower edge of the wall 2 is a hole into which an annular matrix 7 having a conical aperture 8 is inserted. The aperture 8 opens into a horizontally-extending feed duct 9, which leads to a fire chamber 10 and the cross-section of the aperture 8 increases continuously in the direction of the fire chamber. A ram 11 in alignment with the feed duct 9 carries, at its end facing matrix 7, a plunger 12, the cross-section of which is adapted to extend through the aperture 8 with slack. The ram 11 is fastened, at its end remote from the aperture 8, to the piston 13 of a hydraulic cylinder 14. At the end of the outward working stroke of the piston 13, taking place to the left in the drawings, the plunger 12 is disposed in the matrix 7 at the entrance to the feed duct 9, in the position shown in FIG. 1. Arranged in the lower corner toward the fire chamber of each of the side-walls 3 and 5, the left-hand one in FIG. 1, as well as in the side wall 4 opposite the aperture 8, is a respective flap 15, 17 or 16, respectively, which are mounted for oscillation and which can be swung about a pivot connection with the respective side-wall, by means of a respective hydraulic cylinder 18, 20 or 19, respectively, between a closed position in which the flaps are flush with the side-walls and do not extend into the container, and an open position in which the flaps extend into the container 1, a such as shown at 16 in FIG. 1.

Figure 2:
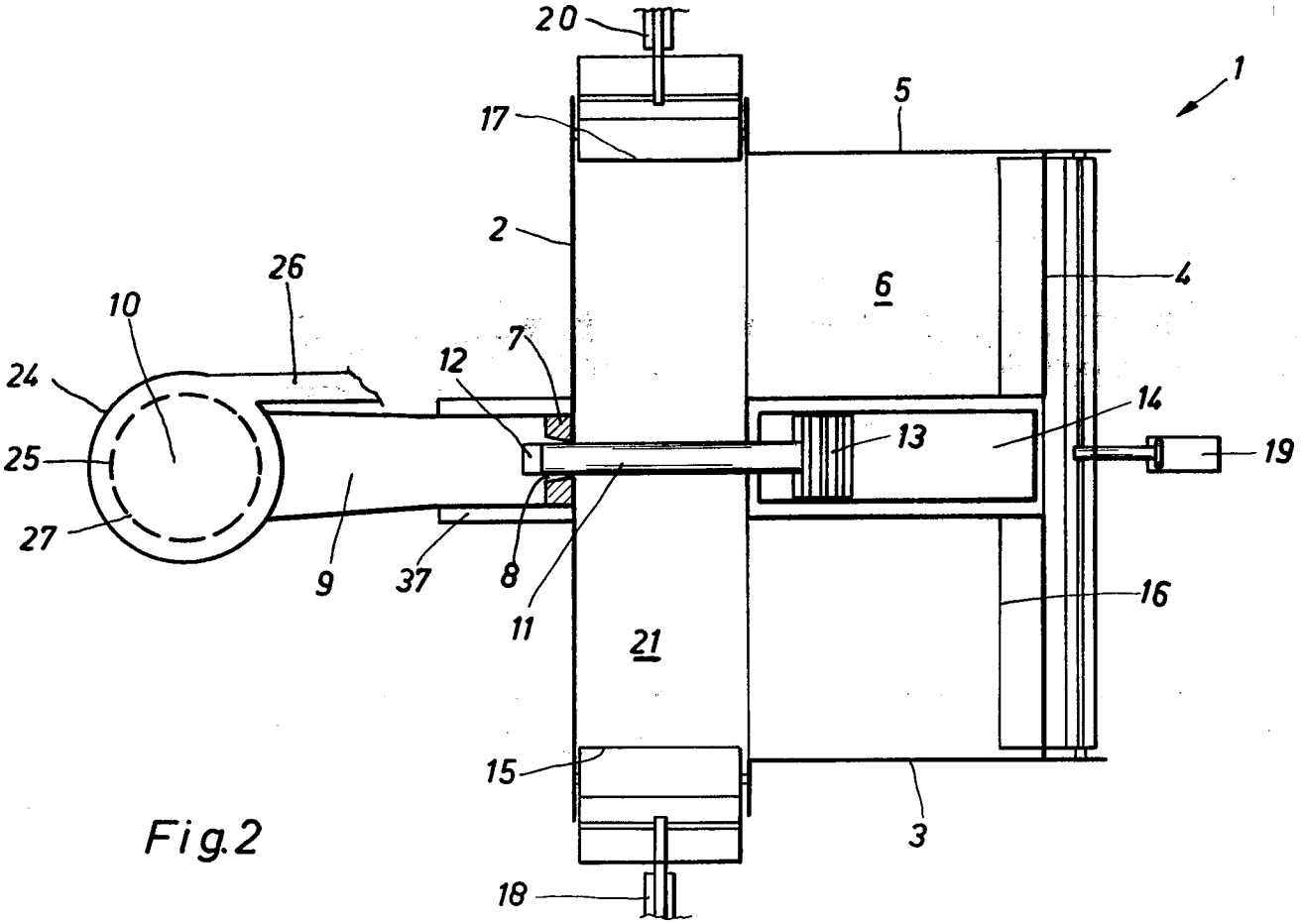
FIG. 2 is a horizontal section view on a reduced scale, taken substantially along the line II—II in FIG. 1.
Figure 4:
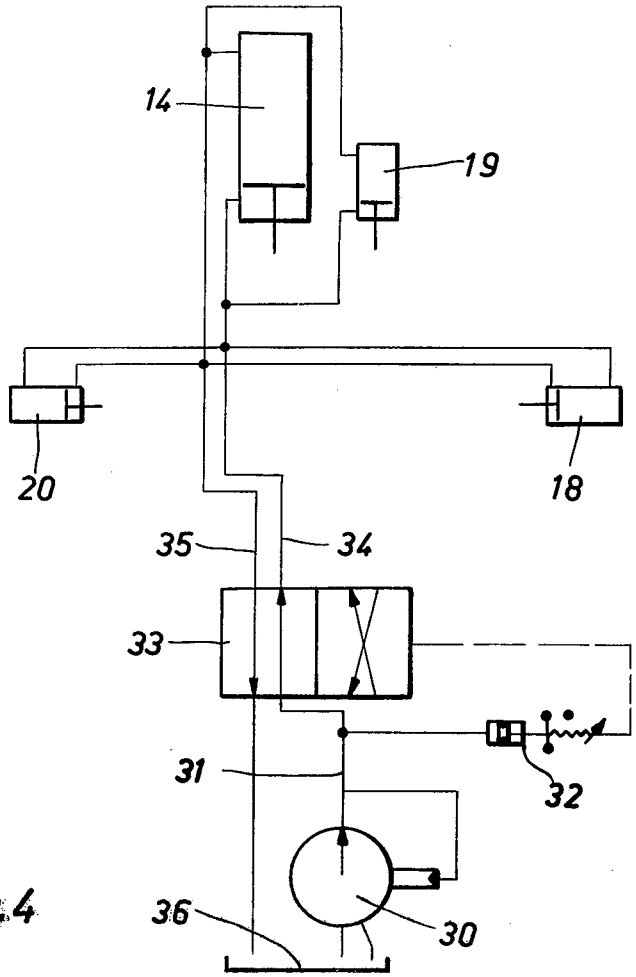
FIG. 4 is a schematic diagram of a hydraulic circuit for actuating the drive device of the ram of the furnace assembly of FIG. 1.
Figure 3:
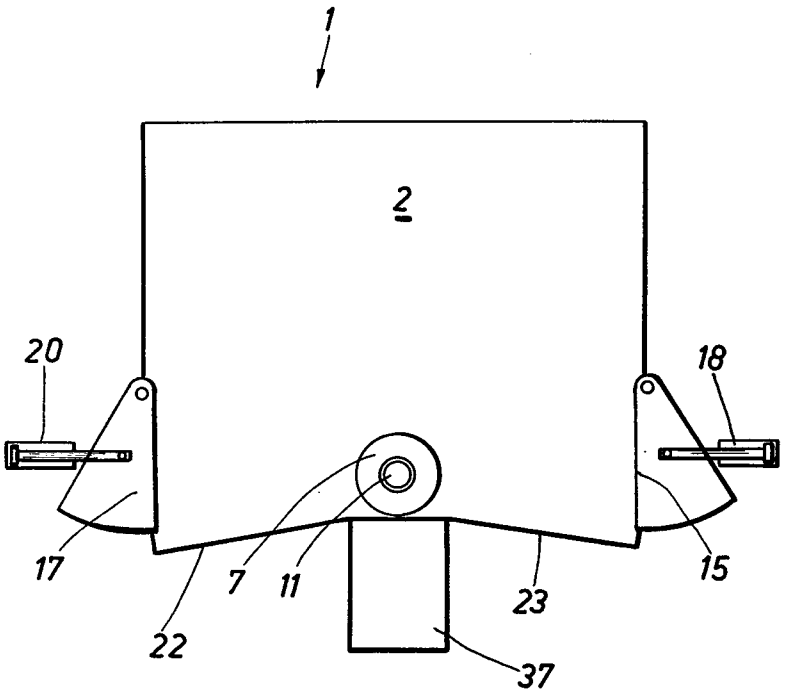
FIG. 3 is a vertical cross-section view, on a reduced scale, taken substantially along the line III—III in FIG. 1.

The hydraulic cylinders 14, 18, 19 and 20 are driven by a common hydraulic circuit arrangement which is shown schematically in FIG. 4, in such a way that at the end of the working stroke of the piston 13 the flaps 15 and 17 are closed and the flap 16 is swung to the open position into the container 1, as shown in FIGS. 1, 2 and 3, and at the end of the withdrawal stroke of the piston 13 the flaps 15 and 17 are swung to the open position into the container 1 and the flap 16 is swung out of the container to the closed position. The working stroke and the withdrawal stroke of the pistons of the hydraulic cylinders 14, 18, 19 and 20 are each limited by stops (not shown).

The bottom wall 6 has a laterally extending rectangular channel 21 which is parallel to the side-wall 2, and the width of which extends between side-wall 2 and the hydraulic cylinder 14, and the bottom of which has two sloping bottom wall portions 22, 23 which extend at an obtuse angle to one another and which drop away from opposite sides of the aperture 8 to the side-walls 3 and 5, as shown in FIG. 3. In this way the result is achieved that bent or curved pieces of wood, for example branches, pass into a position in front of the aperture 8 in which they are readily grasped by the ram 11.

The cylindrical fire chamber 10 has a double jacket 24, 25 with a lower aperture to which the end of the feed duct 9 opposite the aperture 8 is connected in air tight manner. Above this a blower 26 is connected to blow air for combustion through an aperture in the outer jecket 24 tangentially against the inner jacket 25. The air for combustion is heated on the outside of the inner jacket 25 and passes through holes 27, extending obliquely in the inner jacket 25, into the fire chamber 10. An oil burner 28, connected to direct a flame into the top of the inner jacket 25 of the fire chamber 10, is controlled by a control circuit (not shown), provided with a photodetector 29, in such a way that the burner ignites, upon the suspension (or failure) of the photodetector signal indicating the burning or glowing of the wood in the fire chamber 10, and remains switched on for a predetermined period of time.

The hydraulic circuit shown in FIG. 4 has a hydraulic pump 30, to the output line 31 of which there is connected an adjustable pressure switch 32 which, when the set pressure is reached, emits an electrical signal to an electromagneticallyactuatable rotary slide valve 33. The rotary slide valve 33, which can be moved from a first position into a second position and then once more into the first position, connects the line 31, in the first position shown in FIG. 4, to a line 34 and in the second position to a line 35. The return line 35 or 34 respectively, which is in each case not connected to the line 31 is connected by the rotary slide valve 33 to an oil sump 36. Upon arrival of an electrical signal from the pressure switch 32, the rotary slide valve 33 is rotated out of its position into the other position. The pump 30, the pressure switch 32, the rotary slide valve 33, and the oil sump 36 are (in a manner which is not shown) arranged in a hollow pedestal or support 37, FIGS. 1 and 3, which supports the container 1 and the feed duct 9, and which is rectangular in cross-section. The line 34 is connected to the working chambers of the hydraulic cylinders 18 and 20, through the action of which the flaps 15 and 17 are swung into the container 1. The line 34 is also connected to the withdrawal or retraction chamber of the hydraulic cylinder 14 as well as to the retraction chamber of the hydraulic cylinder 19, through the action of which the flap 16 is swung out of its position extending into the container 1 (FIG. 1) into its closure position out of the chamber and in alignment with the side wall 4. The line 35 is connected to the extension chambers of the hydraulic cylinders 14 and 19 and to the retraction chambers of the hydraulic cylinders 18 and 20. The delivery of the pump 30 is conversely proportional to the pressure at the outlet of the pump.

Starting from the position, shown in FIGS. 1 to 4, of the assembly, when the hydraulic pump 30 is switched on the ram 11 and the flap 16 are moved away from the aperture 8 while the flaps 15 and 17 are swung into the container 1. By this movement wood lying against the side-walls 3 and 5 is pushed by the flaps 15 and 17 towards the aperture 8. At the end of the retraction stroke of the hydraulic cylinders 14 and 19 and of the extension or working stroke of the hydraulic cylinders 18 and 20, the movement of the pistons is stopped by the stops, so that the pressure in the hydraulic arrangement rises. When the pressure set at the pressure switch 32 is reached, this emits an electrical signal to the rotary slide valve 33, whereby this latter is changed over into the second position in which the ram 11 and the flap 16 are moved towards the aperture 8 and the flaps 15 and 17 are moved away from the aperture. During this movement the flap 16 transports or pushes any wood lying against the wall 4 towards the aperture 8 and the plunger 12 of the ram 11 contacts and breaks up the wood lying in front of the aperture 8, if the dimensions thereof are greater than the aperture 8, and pushes the splintered and disintegrated as well as the smaller pieces of wood into the feed duct 9, whereby the wood already present in the feed duct 9 is further pushed along feed duct 9 in the direction of the fire chamber 10. At the end of the working or extension stroke of the hydraulic cylinders 14 and 19, the rotary slide valve 33 switches back, in the manner described above, into the first position shwon in FIG. 4. A rotation of the rotary slide valve 33 is also effected when the flap 16 or the plunger 12, or the flap 15 or 17, strikes against a non-movable or non-breakable obstacle, e.g. becomes jammed, so that damage to the assembly is prevented.

Figure 5:
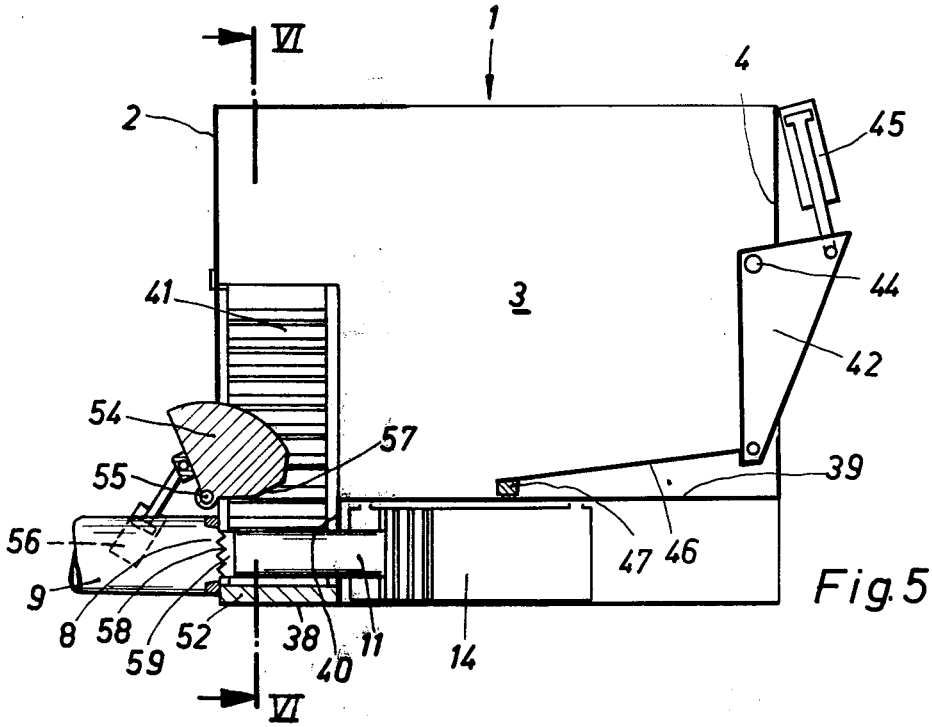
FIG. 5 is a vertical longitudinal section view through a modified form of furnace assembly.
Figure 6:
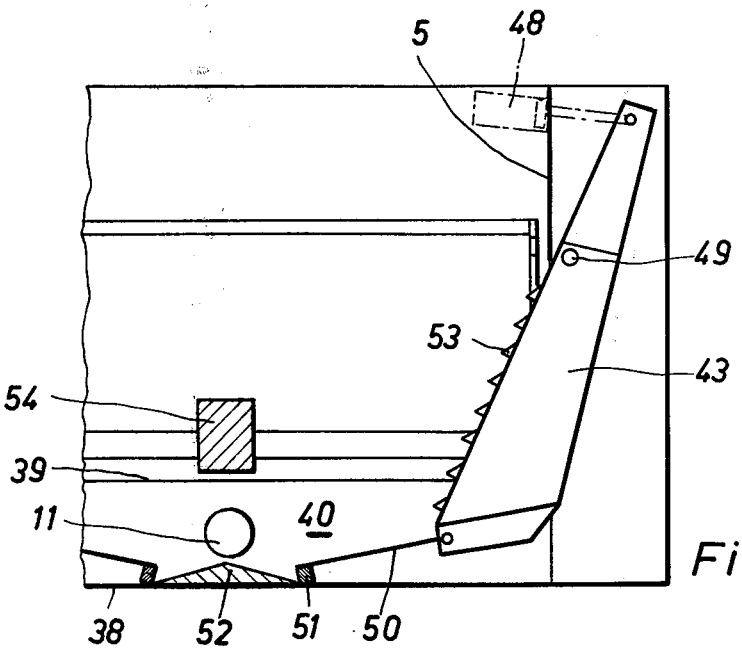
FIG. 6 is a vertical cross-section view taken substantially along the line VI—VI in FIG. 5.

In the case of the modified form of the wood-fired furnace assembly shown in FIGS. 5 and 6, the bottom of the container 1 consists of a lower, horizontally-extending region 38 which adjoins the wall 2, and an upper horizontally-extending region 39 which adjoins the wall 4. The two regions 38 and 39 are connected together by a step 40 parallel to the wall 2. Arranged in openings in each of the walls 3,4 and 5 is a respective flap 41, 42 and 43. The flap 42 in the wall 4 is swingable about a horizontal axis 44 parallel to the wall, from the position shown in FIG. 5 by means of a hydraulic cylinder 45 into a position extending into the container 1. Hinged to the lower edge of the flap 42 is a plate 46, the forward edge of which that is remote from the flap 42 being provided with a sliding strip 47 that slides on the region 39 of the bottom wall. The flap 43 connected in an opening in the wall 5 is mounted so as to be swingable by means of a hydraulic cylinder 48 about an axis 49, parallel to the ram 11, and hinged to its lower edge is a forwardly protruding plate 50 which slides on the region 38 of the bottom wall. In the position shown in FIG. 6, the flap 43 is swung into the container 1, in which position the edge 51 of the plate 50, remote from the flap, lies against an upwardly inclined protuberance 52 of the bottom wall region 38. The protuberance 52 forms upwardly inclined ramp-like surfaces on both sides of the path of the ram, and directly under its path of movement. The surface of the flap 43, facing the container 1, is provided with plural horizonatally extending gripping ribs 53 which are acute-angled in cross-section and which render any sliding of the wood on the surface of the flap impossible. The flap 41 in the wall 3 corresponds in construction to the flap 43.

A depressing member 54, formed by a plate in the shape of a sector of a circle, is mounted through the wall 2 so as to be swingable about a horizontal axis 55 parallel to the wall 2. The member 54 extends through an aperture in the wall 2 into the container 1 and is swung to and fro in the direction of the path of the ram 11 by means of a hydraulic cylinder 56. The member 54 carries an inwardly facing surface 57 thereon which in the inwardly swung position shown in FIG. 5 compresses wood lying in the region thereof downwardly into the path of the ram and then swings back once more into the wall 2.

The ram 11 carries, at its free end facing the aperture 8, a plunger head 59 which is provided with diametrical wedgeshaped grooves 58.

The hydraulic cylinders 14, 45, 48 and 56 are actuated by a hydraulic control circuit (not shown) in such a way that the following movement cycles of the ram 11, the flaps 41–43 and the depressing member 54 occur: Starting from the initial position, shown in FIGS. 5 and 6, of the assembly, in which the ram 11 is at the end of its extension or working stroke, in a first procedural step the ram 11, the flaps 41 and 43 and the depressing member 54 are retracted and moved away from the aperture 8 or the path of the ram 11 respectively; at the end of this step, the plunger head 59 of the ram 11 lies in the region of the step 40, the flaps 41 and 43 are swung into the walls 3 and 5 and the surface 57 of the depressing member 54 is retracted into the wall 2; In a second procedural step, the flap 42 is swung into the container 1, whereupon any wood lying on the region 39 of the bottom wall is transported or pushed over the step 40 into the space between this and the side-wall 2; then the flap 42 swings back once again into the wall 4; in a third procedural step, the flaps 41 and 43 swing into the container 1, in which respect they push the wood lying at the ends of the bottom wall region 38 to the ram path; then the depressing member 54 swings downwards and the surface 57 compresses the wood lying in the region of the ram path as far as possible, in which respect the depressing member 54 more especially in the case of fairly large pieces of wood mostly swings not into the lowermost end position in which the surface 57 lies horizontally at a spacing above the ram path, but into a partially swung position, e.g. the position shown in FIG. 5; at the end of this procedural step, the flaps 41 and 43 and the depressing member 54 are in the positions shown in FIGS. 5 and 6; in the fourth procedural step there now follows the extension working stroke of the ram 11, in which the plunger head 59 breaks up and disintegrates the wood lying in front of the aperture 8 and pushes same through the aperture into the feed duct 9; and at the end of this procedural step, the assembly is once again in the initial position shown in FIGS. 5 and 6.

In this procedural cycle it is essential that upon occurance of the working stroke of the ram the flaps 41 and 43 are swung into the container 1 and the depressing member 54 is in the inward lower position. The flaps 41 and 43 and the depressing member 54 then hold particularly the larger pieces of wood in the region of the ram path and prevent the ram 11 from pushing the pieces of wood away from this region during its forward working stroke instead of breaking them up.

So that the aperture 8 is sealed by the ram 11 in the position of rest of the assembly, the piston 13 of the hydraulic cylinder 14 can, at the end of the working stroke, actuate a switch, in which respect the assembly can be switched off only upon actuation of this switch.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A wood-fired furnace assembly having a fire chamber (10) and an automatic charging device for the fire chamber, comprising a container (1) adapted to receive wood and having a bottom (6,21; 38,39) and side-walls (2-5) adjacent the bottom, an aperture (8) reinforced at its edge connected in the lower edge of one of the side-walls (2), a feed duct (9) connected between said aperture (8) and the fire chamber (10), a ram (11) having a free end (12,59) facing said aperture (8), said free end having a cross-section the same as or smaller than the cross-section of said aperture (8), a drive device (13,14,30) connected to reciprocate said ram (11) along a path in the container (1) to position said free end (12,59) at the end of the working stroke up to or into said aperture (8), the bottom of said container (1) having a region (21,38) adjoining said one side-wall (2) having said aperture (8) therein extending transversely of and on opposite sides of the path of said ram (11) and extending approximately horizontally or inclinded downwardly away from opposite sides of said ram, the transverse dimension of said region being a multiple of the inside width of said aperture (8) so that wood in said container (1) being bigger than the inside width of said aperture (8) can get into a transverse position in front of the aperture (8) and upon the working stroke of the ram (11) can be pushed against the aperture (8) and splintered thereat under pressure from the free end (12,59) of the ram, and a respective pusher member (15,17; 41,43) mounted in each of the two side-walls (3,5) adjoining said one side-wall (2) having said aperture (8) therein which is moved to and fro in the direction toward the path of said ram (11) by means of a respective drive device (18,20, 30; 48), whereby wood lying against the said two side-walls (3,5) is pushed toward said ram path.

2. A furnace assembly as set forth in claim 1, in which said aperture (8) is in the form of an annular matrix (7) inserted into the lower edge of said one side-wall (2) of the container (1), and said ram (11) carries at its end facing the annular matrix (7) a plunger (12; 59) adapted to fit with slack into the aperture (8).

3. A furnace assembly as set forth in claim 1, in which the region (21; 38) of the bottom wall (6) adjoining the side-wall (2) having said aperture (8), includes portions that extend on opposite sides of the path of the ram that are at a lower level than the portion of this region that lies under the path of the ram.

4. A furnace assembly as set forth in claim 1, in which the fire chamber (10) has a double wall (24,25) with a lower aperture to which the feed duct (9) is connected is in airtight relation, and a blower (26) connected through an aperture in the outer wall (24) of said double wall and adapted to blow air between the two walls (24,25) of the double wall, apertures (27) in the inner wall (25) of the double wall, whereby air for combustion is heated at the inner wall (25) of the double wall and passes through the apertures in the inner wall into the fire chamber (10).

5. A furnance assembly as set forth in claim 1, including a pressing member (54) movably mounted above said aperture (8) on said one side-wall (2) and having a front face (57), and a drive device (56) connected to move said pressing member (54) down and up toward and away from the path of said ram (11) to position said front face (57) at the end of the down-stroke at least approximately horizontal at a spacing above the ram path, whereby wood is compressed in front of said aperture (8) between said front face (57) of the pressing member (54) and said region (21,38) of the bottom (6,21; 38,39), adjoining said one side-wall (2).

6. A furnace assembly as set forth in claim 5, in which the drive devices (56,13,14,30) for said pressing member (54) and said ram (11) are controlled such that upon the working stroke of the ram (11) the pressing member (54) is kept at the end of the down-stroke in order to keep the wood compressed in front of the aperture (8) and prevent the ram (11) from pushing wood pieces away instead of splintering them.

7. A furnace assembly as set forth in claim 1, in which said pusher members mounted in said two side-walls (3,5) are flaps (15,17,41,43) which are connected to swing to and fro in the direction toward the path of said ram (11) by means of said drive devices (18, 20, 30; 48).

8. A furnace assembly as set forth in claim 7, in which said container (1) has four side-walls (2–5) which stand at least approximately perpendicular to one another, a flap (16) mounted in the side-wall (4) opposite to said one side-wall (2) having said aperture (8) therein, and connected to be swung to and fro in the direction of the path of said ram (11) by means of a drive device (19;45) whereby wood lying against said opposite sidewall (4) is shifted toward said one said-wall (2).

9. A furnace assembly as set forth in claim 8, in which the side-walls (2-5) stand at least approximately vertically.

10. A furnace assembly as set forth in claim 8, in which the drive devices (14,45,48) for the ram (11) and said flaps (41-43) are controlled such that upon the working stroke of the ram (11) the flaps (41,43) of the adjoining side-walls (3,5) are swung into the container (1) in order to keep the wood in front of the aperture (8).

11. A furnace assembly as set forth in claim 8, including a plate (46,50) hinged to the lower edge of each flap (41–43), said plate having a free edge (47,51) remote from the flap (41–43) which slides on the bottom (38,39) of said container (1).

12. A wood-fired furnace assembly having a fire chamber (10) and an automatic charging device for the fire chamber, comprising a container (1) adapted to receive wood and having a bottom and four side-walls (2–5) which stand at least approximately perpendicular to one another, an aperture (8) reinforced at its edge connected in one of the side-walls (2) adjacent the lower edge thereof, a feed duct (9) connected between said aperture (8) and the fire chamber (10), a ram (11) having a free end (12, 59) facing said aperture (8), said free end having a cross-section the same as or smaller than the cross-section of said aperture (8), a drive device (13,14,30) connected to reciprocate said ram (11) along a path in the container (1) to position said free end (12, 59) at the end of the working stroke up to or into said aperture (8), the bottom of said container (1) having a lower region (21, 38) and a higer region (6,39), said lower region adjoining said one side-wall (2) having said aperture (8) therein extending transversely of and on opposite sides of the path of said ram (11) and extending approximately horizontally or inclined downwardly away from opposite sides of said ram, the transverse dimension of said lower region being a multiple of the diameter of the free end (12,59) of said ram, a respective flap (15–17; 41–43) mounted in each of the two adjoining side-walls (3,5) and in the opposite side-wall (4) which is swung to and fro in the direction of the ram path by means of a respective drive device (18–20; 45,48) whereby wood lying against the side-walls (3–5) is moved toward said aperture (8).

13. A furnace assembly as set forth in claim 12, in which the side-walls (2–5) stand at least approximately vertically.

14. A furnace assembly as set forth in claim 12, in which the drive devices (14, 45, 48) for the ram (11) and said flaps (41–43) are controlled such that upon the working stroke of the ram (11) the flaps (41,43) of the adjoining side-walls (3,5) are swung into the container (1) in order to keep the wood in front of the aperture (8).

15. A furnace assembly as set forth in claim 14, in which said flaps have surfaces facing the ram path, and the surfaces of the flaps (41,43) of the ajoinging side-walls (3,5) being ribbed (53).

16. A furnace assembly as set forth in claim 12, including a plate (46,50) hinged to the lower edge of each flap (41–43), said plate having a free edge (47,51) remote from the flap (41–43) which slides on the bottom (38,39) of said container (1).

17. A furnace assembly as set forth in claim 16, in which the bottom (38,39) of the container (1) includes a step portion (40) disposed substantially parallel to the side-wall (2) containing said aperture (8), whereby that region (38) of the container bottom which adjoins this side-wall (2) lies lower than the region (39) of the container bottom adjoining the opposite wall (4), the flaps (41,43) of the adjoinging side-walls (3,5) connected to be swung to and fro, in the direction of the path of the ram, between the side-wall (2) containing said aperture (8) and said step portion (40), and the free edges (51) of the plates (50) hinged to these flaps (41,43) adopted to slide on the lower region (38) of the container bottom, and the free edge (47) of the plate (46) hinged to the flap (42) of the opposite wall (4) adopted to slide on the higher region (39) of the container bottom.

* * * * *